US006619821B1

(12) United States Patent
Waycaster

(10) Patent No.: US 6,619,821 B1
(45) Date of Patent: Sep. 16, 2003

(54) HIGH EFFICIENCY ASYMMETRICAL OPTICAL ASSEMBLY

(75) Inventor: William Bradley Waycaster, Tupelo, MS (US)

(73) Assignee: Genlyte Thomas Group LLC, Louisville, KY (US)

( * ) Notice: Subject to any disclaimer, the term of this patent is extended or adjusted under 35 U.S.C. 154(b) by 0 days.

(21) Appl. No.: 09/291,868

(22) Filed: Apr. 14, 1999

(51) Int. Cl.[7] ..... F21V 7/00

(52) U.S. Cl. ..... 362/350; 362/297; 362/296; 362/341; 362/347; 362/348; 362/346

(58) Field of Search ..... 362/297, 304, 362/346, 348, 350, 296, 341, 347; 359/884

(56) References Cited

U.S. PATENT DOCUMENTS 4,066,887 A * 1/1978 Levis ..... 362/341
4,207,607 A * 6/1980 Gulliksen ..... 362/282
4,213,171 A * 7/1980 Sassmannshausen ..... 36/310
4,229,782 A * 10/1980 Ruud et al. ..... 362/297
4,231,080 A * 10/1980 Compton ..... 362/298
4,428,038 A * 1/1984 Rakitsch et al. ..... 362/263
4,630,895 A * 12/1986 Abdala, Jr. et al. ..... 350/345
5,010,458 A * 4/1991 Fraizer ..... 362/80
5,493,483 A * 2/1996 Lake ..... 362/346
5,526,248 A * 6/1996 Endo ..... 362/297
6,036,338 A * 3/2000 Gordin ..... 362/350

* cited by examiner

*Primary Examiner*—Thomas M. Sember
*Assistant Examiner*—Anabel Ton
(74) *Attorney, Agent, or Firm*—Jeffery A. Haeberlin; Middleton Reutlinger

(57) ABSTRACT

A parabolic reflector with an asymmetrical light distribution is disclosed. The inside surface of the reflector is divided into four quadrants, and two of the four opposing quadrants are coated with a reflective material. The two remaining quadrants are uncoated or specular. With the uncoated quadrants aligned along a longitudinal center line of a narrow area to be lit, the reflector provides an asymmetrical or elliptical light distribution for more efficient lighting of narrow hallways and passageways. The reflector is particularly useful in a warehouse environment.

15 Claims, 2 Drawing Sheets

HIGH EFFICIENCY ASYMMETRICAL OPTICAL ASSEMBLY

FIELD OF THE INVENTION

The present invention relates generally to lighting systems and, more specifically, to parabolic reflectors. Still more specifically, the present invention relates to a parabolic reflector capable of delivering an asymmetrical light distribution.

BACKGROUND OF THE INVENTION

Light fixtures that include reflectors, such as parabolic reflectors, have numerous applications. One typical application for a parabolic reflector is a light fixture that hangs from a ceiling for lighting a narrow walkway or hallway disposed between two walls or two banks of shelves, such as an in a warehouse or in a storage facility. An example of such an application is illustrated schematically in FIG. 1. Specifically, a light fixture 10 is shown hanging between two shelving units 11, 12. The area 13 to be lit is relatively narrow. Because a typical light fixture 10 will provide a circular light distribution (not shown), a number of light fixtures 10 must be strung along the walkway or area 13 to be lit.

A circular light distribution for the arrangement shown in FIG. 1 is inefficient because it is desirable to direct the light downward to cover as much of the area 13 as possible without wasting light on the top surfaces 14, 15 of the shelving units 11, 12 respectively or along the upper portions 16, 17 of the shelving units 11, 12 respectively. For efficiency, the light must be directed downward toward the floor or walkway.

Therefore, a conventional circular light distribution (not shown) for the light fixture 10 would be inefficient. Large amounts of the light distribution would be wasted on the upper sides 16, 17 and top surfaces 14, 15 of the shelving units 11, 12. Further, a circular light distribution would not provide an effective distribution of light in the direction of the arrows 18, 19 or along the narrow area 13 that needs to be lit.

As a result, light manufacturers have developed light fixtures that provide an elliptical light distribution. However, conventional methods for converting a parabolic light reflector so that it produces an elliptical or asymmetrical light distribution as opposed to a circular or symmetrical light distribution reduces the efficiency of the fixture. Specifically, the typical means for producing an elliptical distribution from a parabolic light reflector includes the use of an insert or refractor inside the reflector. The inserts and refractors, in addition to being costly, reduce the efficiency of the light fixture or luminaire. As a result, while an elliptical light distribution is achieved, less light is distributed and the overall efficiency is reduced as a result.

Accordingly, there is a need for a conventional parabolic reflector that efficiency produces an elliptical light distribution for lighting narrow hallways and walkways such as those illustrated in FIG. 1.

SUMMARY OF THE INVENTION

The present invention satisfies the aforenoted need by providing a light fixture that comprises a parabolic reflector which, in turn, comprises an inside surface. The inside surface of the reflector comprises four quadrants including two coated quadrants disposed between two uncoated quadrants.

In an embodiment, the reflector is fabricated from aluminum so that the uncoated quadrant provide an aluminum surface for the reflection of light.

In an embodiment, the coated quadrants are coated with a white paint.

In an embodiment, the coated quadrants are coated with a white powdered coating.

It has been found that by aligning the coated quadrants on opposing sides of a center line that extends longitudinally through the narrow area to be coated, an elliptical light distribution is achieved without substantially reducing the efficiency of the reflector.

In other words, the amount of light distributed by a parabolic reflector coated as described above is substantially the same amount as the light reflected by a completely uncoated or metallic parabolic reflector.

The coating of opposing quadrants in accordance with the present invention is more economical than conventional parabolic reflectors that provide an elliptical light distribution. Specifically, typical reflectors provide an elliptical or asymmetric distribution utilize a refractor or an insert which, both add to the cost of the reflector or the luminaire, and which also reduce the efficiency of the luminaire. Painting of opposing quadrants with a highly reflective paint, such as a white paint, or white powdered coating is cheaper than the use of refractors or inserts and further achieves the asymmetric or elliptical light distribution without sacrificing overall optical efficiency.

The two uncoated or specular quadrants will distribute light in accordance with the normal distribution pattern of the reflector. Accordingly, the two uncoated or specular quadrants should be aligned with the center line of the aisle or passageway to be lit. The painted quadrants should be disposed on opposing sides of the center line or longitudinal axis of the aisle or passageway to be lit. The painted quadrants will disperse the light along the hallway to provide an asymmetrical light distribution which will also soften the lumen intensity thereby reducing glare.

In an embodiment, the present invention provides a method for manufacturing a reflector for providing asymmetrical light distribution which includes the steps of providing a metallic parabolic reflector comprising an inside surface, and coating two opposing quadrants of the inside surface with a white coating so that the inside surface is characterized as having four quadrants including two coated quadrants disposed between two uncoated quadrants.

In an embodiment, the coating step further comprises coating the opposing quadrants with a white powdered coating.

It is therefore an advantage of the present invention to provide a simple, economical and highly efficient means for providing an asymmetrical light distribution.

It is another advantage of the present invention to provide an effective means for converting a conventional parabolic reflector that would normally generate a circular light distribution to a reflector that generates an asymmetrical light distribution.

Other objects and advantages of the present invention will become apparent to those skilled in the art upon reviewing the following detailed description, drawings and appended claims.

BRIEF DESCRIPTION OF THE DRAWINGS

For a more complete understanding of the present invention, reference should now be made to the embodiments illustrated in greater detail in the accompanying drawings and described below by way of an example of the invention.

In the drawings.

It should be understood that the drawings are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted. It should be understood, of course, that the invention is not necessarily limited to the particular embodiments illustrated herein.

DETAILED DESCRIPTION OF THE PRESENTLY PREFERRED EMBODIMENTS

Figure 1:
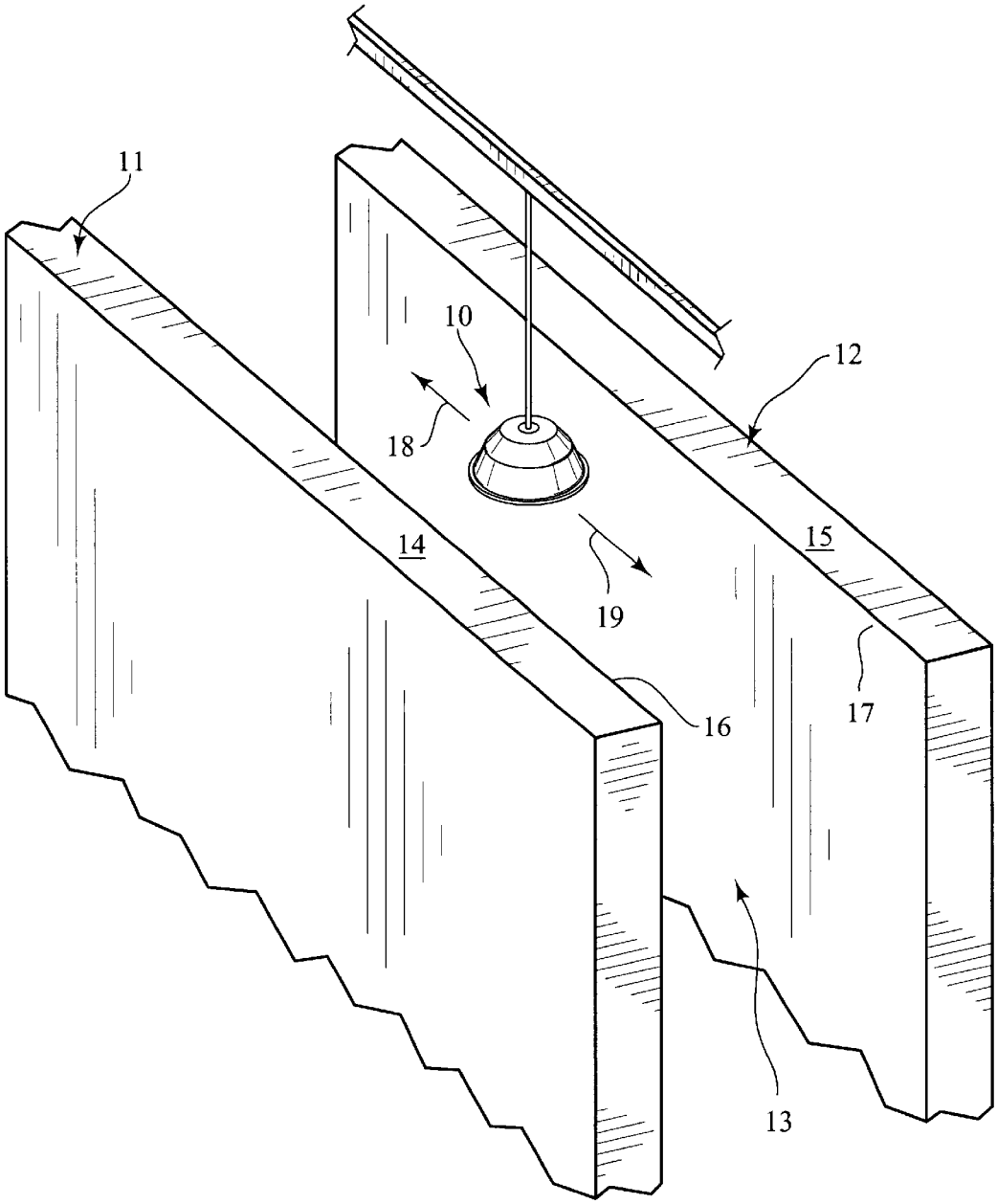
FIG. 1 is a schematic illustration of a narrow area or hallway that can be lit using the asymmetrical light distribution provided by light fixtures made in accordance with the present invention.
Figure 2:
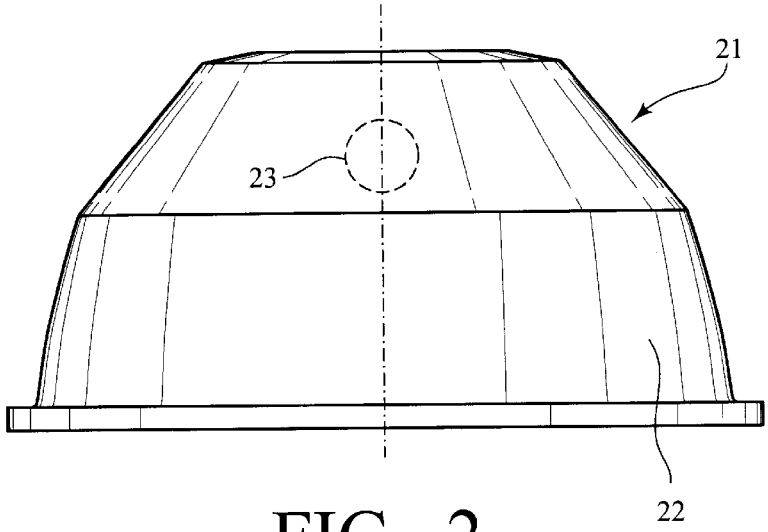
FIG. 2 is a side view of a parabolic reflector made in accordance with the present invention.
Figure 3:
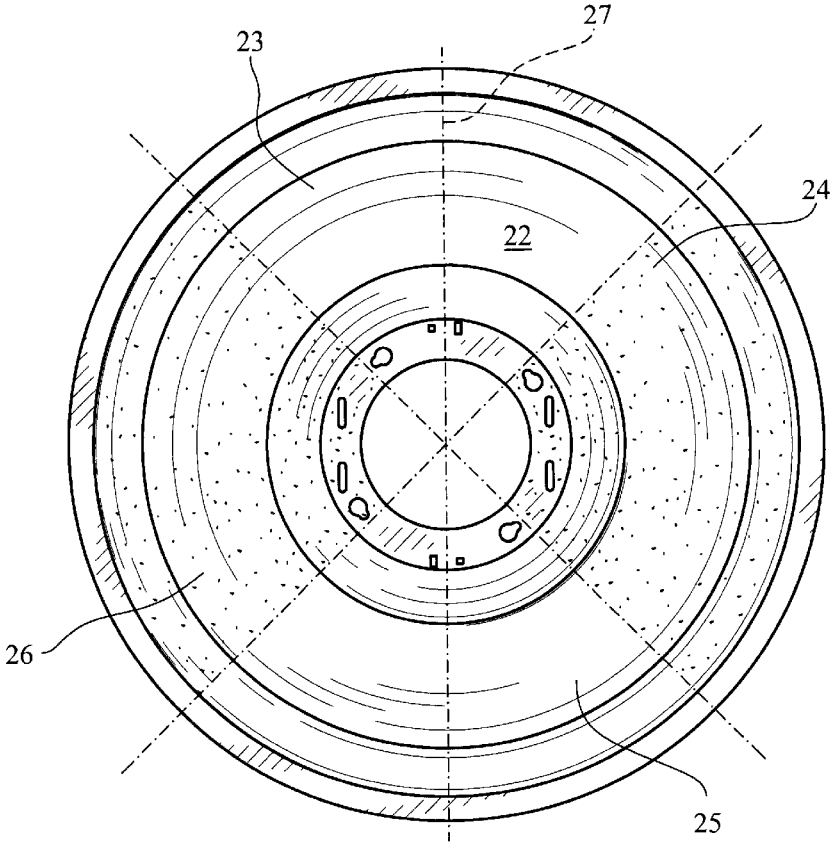
FIG. 3 is a bottom plan view of a parabolic light reflector made in accordance with the present invention.

Turning to FIG. 2, a side view of a reflector 21 is illustrated with a generally parabolically shaped inside surface 22. A light source is shown in phantom at 23. Without any treatment in accordance with the present invention, the inside surface 22 would reflect a generally circular or symmetrical light distribution. However, turning to FIG. 3, it can be seen that the surface 22 has been divided into four quadrants 23, 24, 25, 26. Opposing quadrants 24 and 26 have been coated while opposing quadrants 23 and 25 remain uncoated. Typically, the reflector 21 is fabricated from aluminum, due to its high reflectivity and low cost. Thus, the uncoated or specular quadrants 23 and 25 reflect light in the intended manner. Accordingly, to light a narrow hallway, such as the one shown at 13 in FIG. 1, quadrants 23 and 25 should be aligned along the center line or longitudinal center of the hallway.

In contrast, the coated quadrants 24 and 26 should be disposed on opposing sides of the center line of the area to be illuminated. It has been found that coating the quadrants 24 and 26 with a reflective coating, preferably a white coating, that light is diffused in the directions shown by the arrows 18 and 19 in FIG. 1 or along the center line 27 shown in FIG. 3. The diffusion of the light further softens the lumen intensity and thereby reduces glare as well. The painting or coating of the quadrants 24 and 26 is inexpensive and therefore more economical than using specially designed inserts or refractors. As a result, a reflector 21 which would normally produce a symmetrical or circular light distribution can be easily modified to produce an asymmetrical or elliptical light distribution for narrow configurations such as that shown in FIG. 1.

In a preferred embodiment, the coating applied to the quadrants 24 and 26 is a powdered coating sold under the designation LZ7578-5 by Ferro Corporation of Cleveland, Ohio.

From the above description it is apparent that the objets of the present invention have been achieved. While only certain embodiments have been set forth, alternative embodiments and various modifications will be apparent from the above description to those skilled in the art. These and other alternatives are considered equivalents and within the spirit and scope of the present invention.

What is claimed is:

1. A light fixture comprising:

a metallic parabolic reflector comprising a continuous metallic inside surface, the inside surface comprising four quadrants including two quadrants coated with a diffuse reflective material disposed between two uncoated specular metallic quadrants.

2. The light fixture of claim 1 wherein the reflector is fabricated from aluminum.

3. The light fixture of claim 1 wherein the reflective material is a white paint.

4. The light fixture of claim 1 wherein the reflective material is a white powdered coating.

5. A reflector for providing an asynmetrical light distribution, the reflector comprising;

a continuous metallic parabolic inside surface comprising four quadrants including two quadrants coated with a diffuse reflective material disposed between two uncoated specular metallic quadrants.

6. The reflector of claim 5 wherein the reflector is fabricated from aluminum.

7. The reflector of claim 5 wherein the reflective material is a white paint.

8. The reflector of claim 5 wherein the reflective material is a white powdered coating.

9. A light fixture comprising:

a light source mounted within a metallic parabolic reflector, the parabolic reflector comprising a continuous metallic inside surface, the metallic inside surface comprising four quadrants including two quadrants coated with a diffuse reflective material disposed between two uncoated specular metallic quadrants.

10. The light fixture of claim 9 wherein the reflector is fabricated from aluminum.

11. The light fixture of claim 9 wherein the reflective material is a powdered coating.

12. A reflector for providing an asymmetrical light distribution, the reflector comprising:

a continuous metallic parabolic inside surface comprising four quadrants including two quadrants coated with a diffuse reflective material disposed between two uncoated specular metallic quadrants, the reflective material being a white coating.

13. The reflector of claim 12 wherein the coated quadrants are coated with a white powdered coating.

14. A method of manufacturing a reflector for providing an asymmetrical light distribution, the method comprising the steps of:

providing a metallic parabolic reflector comprising a continuous metallic inside surface, coating two opposing quadrants of the metallic inside surface with a diffuse reflective coating so that the inside surface is characterized as having four quadrants including two quadrants coated with the diffuse reflective coating disposed between two uncoated specular metallic quadrants.

15. The method of claim 14 wherein the coating step further comprises coating the two opposing quadrants a white powdered coating.

* * * * *